US009217410B2

(12) United States Patent
Turner et al.

(10) Patent No.: US 9,217,410 B2
(45) Date of Patent: Dec. 22, 2015

(54) SINGLE POINT ENGINE CONTROL INTERFACE

(71) Applicant: Generac Power Systems, Inc., Waukesha, WI (US)

(72) Inventors: Chris Turner, Whitewater, WI (US); Kevin Cole, Janesville, WI (US); Jennifer Caldwell, Janesville, WI (US)

(73) Assignee: Generac Power Systems, Inc., Waukesha, WI (US)

( * ) Notice: Subject to any disclaimer, the term of this patent is extended or adjusted under 35 U.S.C. 154(b) by 392 days.

(21) Appl. No.: 13/727,100

(22) Filed: Dec. 26, 2012

(65) Prior Publication Data

US 2014/0174393 A1 Jun. 26, 2014

(51) Int. Cl.
*F02N 19/00* (2010.01)
*F02M 1/02* (2006.01)

(52) U.S. Cl.
CPC ..... *F02N 19/001* (2013.01); *F02M 1/02* (2013.01); *F02N 2019/002* (2013.01)

(58) Field of Classification Search
CPC ..... F02N 99/002; F02N 99/008; F02D 9/107; F02M 1/02; F02M 1/04; F02M 5/08
USPC ..... 123/179.9, 185.2–185.6, 337
See application file for complete search history.

(56) References Cited

U.S. PATENT DOCUMENTS 3,307,836 A * 3/1967 Arndt et al. ..... 261/34.1
3,451,383 A * 6/1969 Nelson ..... 123/179.9
5,211,144 A 5/1993 Collins et al.
5,611,312 A * 3/1997 Swanson et al. ..... 123/436
6,481,403 B1 * 11/2002 Ashcraft et al. ..... 123/179.11
6,848,405 B1 * 2/2005 Dow et al. ..... 123/179.18
6,857,410 B2 * 2/2005 Davis et al. ..... 123/195 R
2004/0130039 A1 * 7/2004 Suzuki et al. ..... 261/23.2
2006/0180113 A1 * 8/2006 Pattullo ..... 123/179.18
2006/0249117 A1 11/2006 Davis
2008/0191369 A1 * 8/2008 Reynolds et al. ..... 261/64.1

(Continued)

FOREIGN PATENT DOCUMENTS

JP 2002-309959 10/2002
JP 2003-120314 4/2003

OTHER PUBLICATIONS

English Translation of JP 2002-3009959.*

(Continued)

*Primary Examiner* — John Kwon
*Assistant Examiner* — Johnny H Hoang
(74) *Attorney, Agent, or Firm* — Boyle Fredrickson, S.C.

(57) ABSTRACT

A control system for manipulating operation of an engine of a portable engine powered device includes a choke and primer control that simplifies starting of the engine. The control system includes a dial that is associated with a choke control to effectuate choking of the engine during starting of the engine. The control system includes a primer control that is configured to provide an initial fuel charge to the engine. Preferably, the control system includes a single input that effectuates both the choke and primer operations associated with starting the engine. Preferably, the dial is moveable in a rotational direction to effectuate the choking operation and is movable in a longitudinal or axial direction to effectuate the priming operation such that user interaction with only the single input effectuates the sequence of the engine starting fuel control.

18 Claims, 7 Drawing Sheets

(56) References Cited

U.S. PATENT DOCUMENTS

| | | | | |
|---|---|---|---|---|
| 2008/0258320 | A1* | 10/2008 | Pattullo | 261/52 |
| 2011/0030640 | A1 | 2/2011 | Raasch | |
| 2012/0161342 | A1* | 6/2012 | Shebuski | 261/64.6 |

OTHER PUBLICATIONS

English Translation of JP 2003-120314.*

PCT/US2013/076815, International Search Report and Written Opinion dated Apr. 15, 2014, 13 pages.

* cited by examiner

SINGLE POINT ENGINE CONTROL INTERFACE

FIELD OF THE INVENTION

The present invention relates generally to gaseous fueled portable engine powered devices, and in particular, to a control assembly that is operable to both prime and choke the engine during the engine starting process.

BACKGROUND OF THE INVENTION

Portable internal combustion engines are used in a wide variety of applications, such as lawn mowers, snow blowers, chain saws, electrical generators, power-washers, etc. Although some such devices can be equipped with an internal combustion engine that can be electro-mechanically started, providing such a power start system substantially increases the weight of the resultant device thereby detracting from the portability of the device. Such electric starting systems can also dramatically increase the costs associated with manufacturing and maintaining the operability of such a device. Accordingly, many light-weight or portable engine powered devices are commonly provided as a manual start engine. Although powered starting systems simplify the starting operation of such devices, the components and systems necessary to facilitate the powered starting of the engine often renders such devices non-portable in as much as more than a single user and/or supplemental equipment is often required to move such devices.

Portable engine driven devices are commonly provided in a number of sizes to satisfy a user's expected usage of the device without unnecessarily increasing the weight and costs associated with the same. Such devices include an internal combustion engine that is operatively connected to a working device, such as an electrical generator, a water pump, etc., configured to provide the desired output associated with operation of the engine. The engine of such devices is commonly manually started via user interaction and/or operation of a recoil. Without the electro-mechanical starting systems, the recoil provides the initial rotation of the crank thereby effectuating the initial compression cycle associated with operation of the engine. Efficient starting of such manually started engines commonly requires some degree of experience or familiarity with engine operation and/or the device configuration so as to avoid unnecessary efforts in starting the engine.

Manually started engines commonly include an ON/OFF switch or key switch associated with communicating an electrical signal to a spark plug during operation of the recoil as well as operation of the engine after the engine has started. Such engine systems commonly provide a fault or ground associated with turning the engine OFF. The fault results in suspension of the generation of the spark signal. The internal combustion engine cannot be started during operation of the recoil when the fault condition exists. Accordingly, one aspect of starting a manually starting engine is to attend to the electrical system of the engine to ensure a spark signal will be generated during operation of the recoil.

Another consideration to ensure efficient or expeditious starting of the engine is the communication of a desired charge of a combustion fuel to the combustion chamber. Many manually started engines include one or more of a choke or choke control, a primer or primer control, and/or an engine throttle control. Manipulation of any of these fuel or combustion charge flow controls alters the amount of fuel and/or air provided to the combustion chamber and/or the throttle assembly and affect starting and/or operation of the underlying engine. Failure to properly attend to the fuel, throttle, and/or primer controls can prolong the efforts associated with starting the engine.

Further complicating engine starting performance, the user must consider the recent condition of the engine in addition to the location and manipulation of the ignition and fuel controls discussed above. For instance, when attempting to start a "cold" engine or engine that has not be operated for some duration, it is commonly necessary to both prime the engine and choke the throttle. Once the engine turns over under its own power, the user must commonly manipulate one or more of the choke, the throttle, and/or the primer to avoid unnecessary pulls of the recoil. Failure to properly attend to one or more of the choke, throttle, and/or primer in a manner and/or sequence specific to the operating characteristics associated with the engine can result in "flooding" of the engine or a condition wherein too much fuel is present in the combustion chamber to effectuate starting of the engine. Although a flooded engine can commonly be started with subsequent starting efforts—such as manipulation of the fuel and throttle controls and pulling of the recoil, recovering from a flooded engine condition only frustrates a user's ability to expeditiously start the affected engine.

For those conditions where an engine has been operated for a sufficient duration so as to "warm-up" or even reach a normal operating temperature, subsequent starting sequences are not commonly the same as the cold engine starting sequence. That is, a warm engine will commonly start with no or only minimal manipulation of any of the primer system, choke system, and/or throttle systems from a normal operating orientation. The various nuances associated with engine starting sequences, the various locations associated with the spark electronic signal, priming, choke, and/or throttle controls, and the desired sequencing associated with the manipulation of such controls can frustrate the ability of even experienced user's to efficiently start a manually started engine associated with many small portable engine powered devices.

Therefore, there is a need for a manually started internal combustion engine control system that associates more than one of the spark control, fuel primer control, choke control, and the throttle control to effectuate efficient starting of the underlying internal combustion engine.

SUMMARY OF THE INVENTION

The present invention is directed to a manually started internal combustion engine control assembly or system that overcomes one or more of the aforementioned drawbacks. One aspect of the invention discloses a control system for manipulating operation of an engine of a portable engine powered device. The control system includes a choke and primer control that simplifies starting of the engine. The control system includes a dial that is associated with a choke control to effectuate choking of the engine during starting of the engine. The control system includes a primer control that is configured to provide an initial fuel charge to the engine. Preferably, the control system includes a single input that effectuates both the choke and primer operations associated with starting the engine. Preferably, the dial is moveable in a rotational direction to effectuate the choking operation and is movable in a axial direction to effectuate the priming operation such that user interaction with only the single input effectuates the desired sequence of the engine starting fuel control.

Another aspect of the invention discloses a control assembly for manipulating operation of an internal combustion engine that is useable with one or more of the features or aspects disclosed above. The control assembly includes a choke control system that is connectable to a throttle body and has a choke control that can manipulate a position of a plate associated with the throttle body. The control assembly includes a primer system that is connected to the choke control system. The primer system includes a primer control that is configured to prime an engine associated with the throttle body. One of the choke control system and the primer control system is disposed behind the other of the choke control system and the primer control system. Preferably, manipulation of the primer system and the choke control system is controlled by a simple input that is operable in one direction to operate the choke and a second direction to operate the primer system.

Another aspect of the invention discloses a control assembly for manipulating operation of an engine of a portable device that is useable with one or more of the features or aspects disclosed above. The control assembly includes a choke control having a dial that is rotatable relative to a housing. A cam is connected to the dial and connected to a choke assembly to manipulate an orientation of a plate relative to a throttle body. A primer control is connected to the fuel supply and configured to prime the engine.

Another aspect of the invention discloses a portable engine powered device that is useable with one or more of the features or aspects disclosed above. The engine powered device includes a throttle body having a moveable plate that is connected to an internal combustion engine. The device includes a choke control having a dial supported by a housing such that rotation of the dial manipulates a position of the plate. A primer control is connected to the choke control and a fuel system associated with operation of the internal combustion engine such that operation of the primer control communicates an initial fuel charge to the throttle body.

Other aspects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

The drawings illustrate the best mode presently contemplated of carrying out the invention.

In the drawings.

DETAILED DESCRIPTION OF THE DRAWINGS

Figure 1:
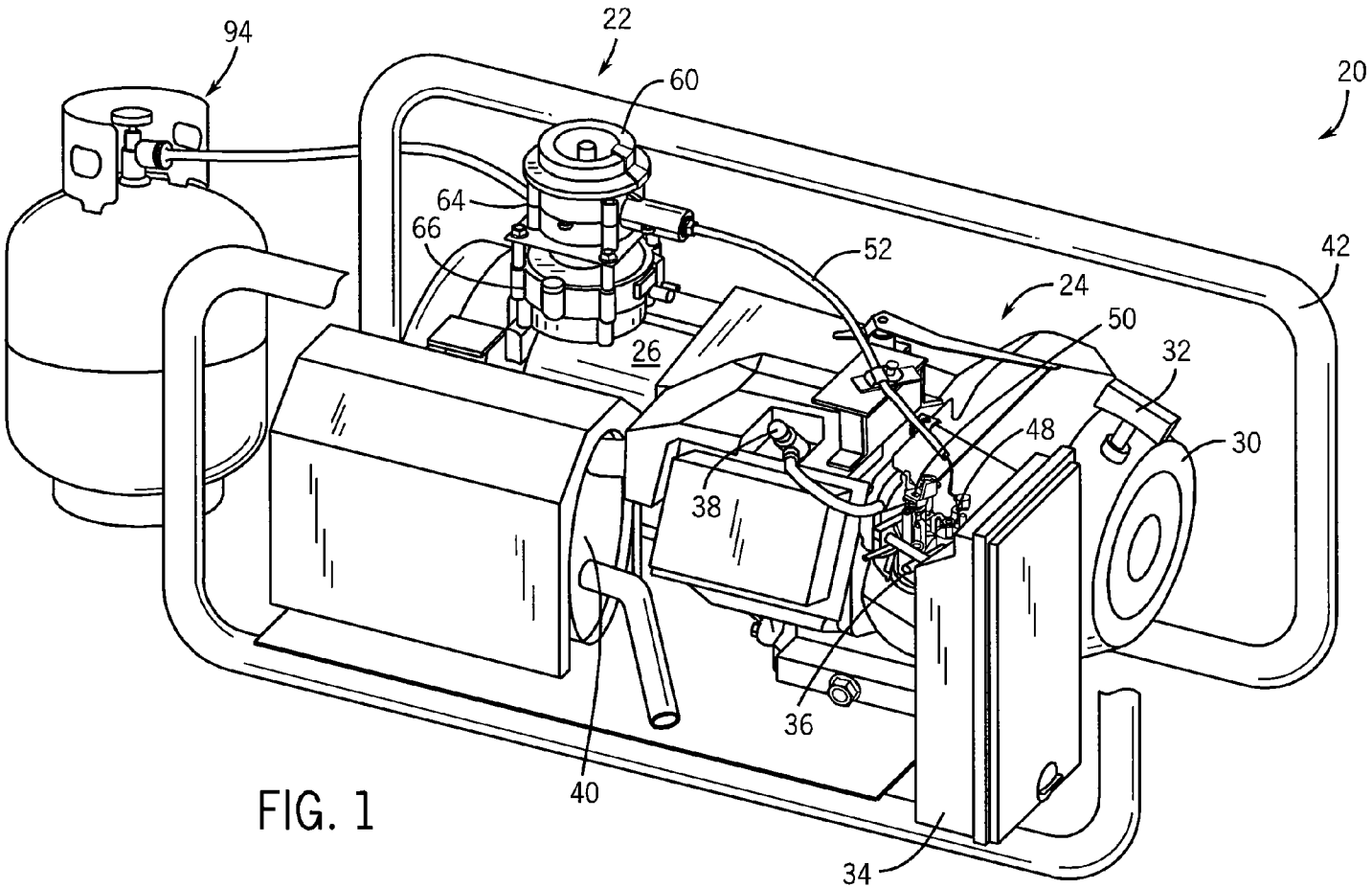
FIG. 1 is a perspective view of a portable engine powered device equipped with an engine control system according to the present invention.

FIG. 1 shows a portable engine powered device 20 equipped with an engine control, engine start control, or start control 22 according to the present invention. Referring to FIGS. 1-4, device 20 includes an internal combustion engine 24 that is connected to an output device, such as an electrical generator 26, which is powered by operation of engine 24. Generator 26 is connected to one or more electrical outputs or outlets 28 (FIG. 2) that are configured to communicate a desired electrical signal to an auxiliary tool, device, or system intended to be powered by operation of device 20. Although shown as a generator, it is appreciated that engine 24 could be connected to any of a number of output devices, such as a pump when device 20 is provided in other configurations such as a power washer, or a drive train when the output device is configured for cutting, trimming applications, or a device configured for snow blowing as but a few examples of equipment commonly powered by an internal combustion engine. It is appreciated that the examples provided above are not all-inclusive of the industries and devices usable with the present invention Engine 24 of device 20 includes a recoil 30 that is utilized for starting of engine 24. As is commonly understood, user interaction with a handle 32 of recoil 30 causes rotation of the crank to generate an initial compression cycle associated with starting of the engine. Engine 24 includes an air intake 34 that is connected to a carburetor, throttle body, or throttle assembly 36. Air intake 34 is configured to communicate a combustion gas or air to engine 24 and preferably includes a filter or other such device to prevent dirt, dust or debris from passing into engine 24. A spark plug 38 is exposed to a combustion chamber of engine 24 and is configured to provide an ignition signal to the combustion charge delivered to the combustion chamber. As is commonly understood, the volume and fuel/air ratio delivered to the combustion chamber are manipulated to effectuate starting and the operational speed of engine.

Device 20 includes a muffler or exhaust 40 that receives the combustion byproducts and discharges the combustion byproducts from engine 24. Preferably, device 20 includes a chassis, space-frame 42, or possibly a full enclosure that generally defines a footprint of device 20 in order to prevent incidental contacts with the operating components of the device as well as to provide convenient grip locations associated with manual transport of device 20. Although shown as a generally open structure, it is appreciated that space-frame 42 can be provided in any number of shapes and/or include a number of removable panels configured to more generally enclose the operating components of device 20 without interfering with user interaction with the operable components of the device such as start control 22 and handle 32 of recoil 30. As is commonly understood, user manipulation of throttle and/or choke controls as well as the ignition system associated with spark plug 38 and operation of recoil 30 via handle 32 effectuates starting and operation of engine 24 and thereby operation of output device 26.

Throttle assembly 36 includes a choke control linkage 48 and a throttle control linkage 50 associated with communicating a desired combustion charge to the combustion chamber of engine 24. Choke control linkage 48 is connected to start control 22 via a choke cable 52 to allow a user to manually manipulate the orientation of a choke plate relative to throttle assembly 36. Throttle control linkage 50 can be manually adjusted to manipulate the orientation of a throttle plate and/or be automatically adjusted in response to the operating condition of engine 24. As is commonly understood, the manipulation of the one or more plates associated with throttle assembly 36 manipulates the fuel/air ratio associated with the various stages of starting and/or extended operation or running of engine 24.

Referring to FIGS. 3-6, start control 22 includes a knob or dial 60, an ignition control 62, a choke control 64, and a primer control 66. Dial 60 rotatably cooperates with start control 22 as indicated by arrow 68 (FIG. 4) and is axially movable in longitudinal direction along the axis associated with rotation 68, indicated by arrow 70, (FIG. 2) to facilitate the desired manipulation or interaction with choke control 64 and primer control 66. As explained further below, dial 60 is movable between a first rotational position associated with an engine "OFF" condition, a second rotational position associated with an engine "PRIME" operation, and third rotational position associate with an engine "RUN" condition. As is also explained further below with respect to FIGS. 7-10, when in the second rotational or "PRIME" position, dial 60 is also movable in an axial or a longitudinal direction along the axis associated with rotation of dial 60 between a first longitudinal position and a second longitudinal position along the axis of rotation to effectuate operation of primer control 60.

Figures 2, 3:
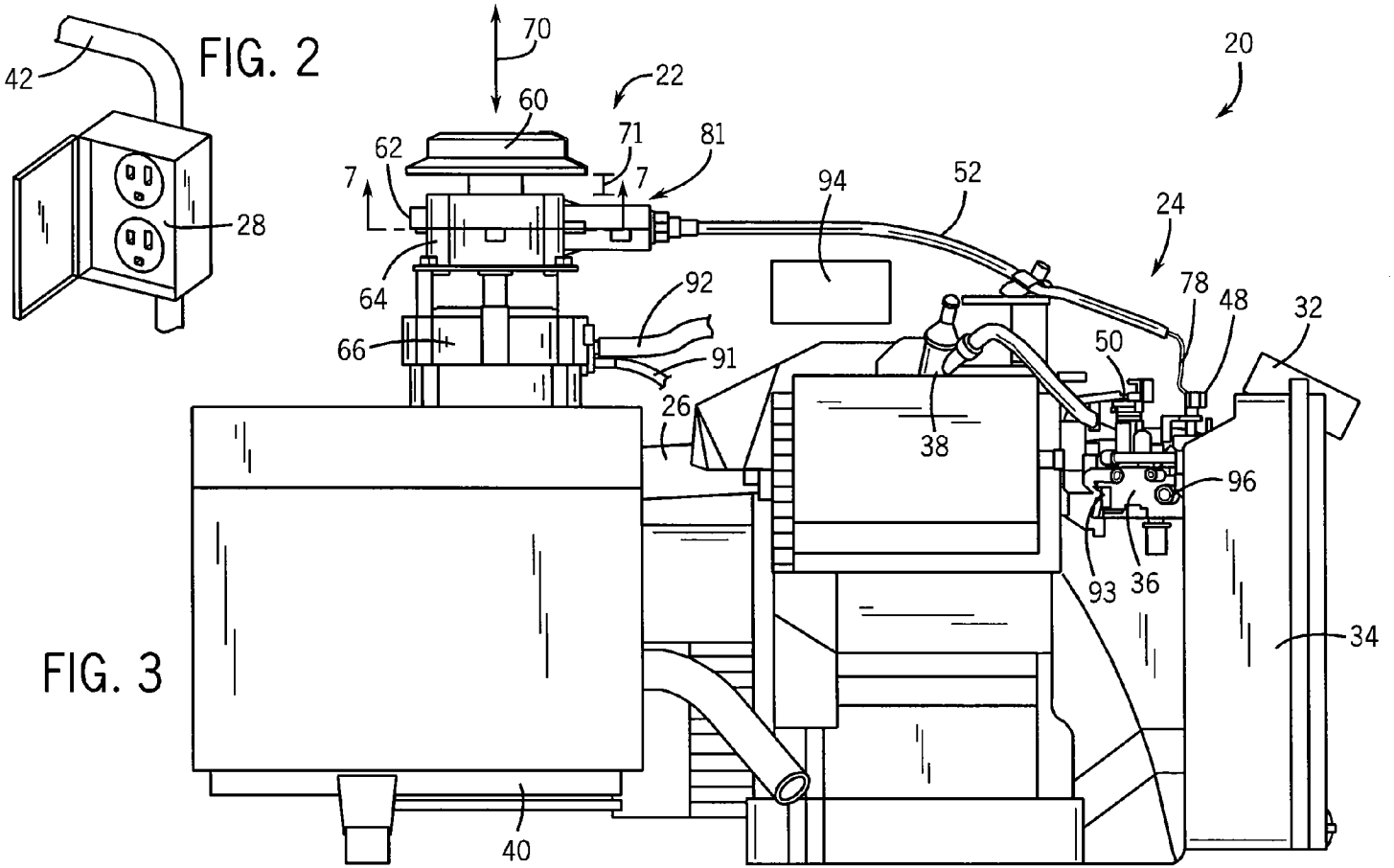
FIG. 2 is a perspective view of an electrical output associated with operation of the engine powered device shown in FIG. 1.
FIG. 3 is a longitudinal side view of the assembly shown in FIG. 1 with a support frame removed therefrom.

As shown in FIG. 3, a gap 71 is provided between dial 60 and choke control 64 to facilitate the axial translation therebetween. Dial 60 is preferably biased toward the first longitudinal position, as shown in FIG. 3, to maintain gap 71 until a "PRIME" operation is effectuated by the user's pressing downward of dial 60 toward primer control 66. Dial 60 preferably includes an indicator 72 that provides a visual indication as to the radial orientation of dial 60 relative to a housing assembly or housing 74 of start control 22. It is further appreciated that the cooperation of dial 60 with choke control 64 and/or primer control 66 can include one or more tactile indications associated with the various orientations of dial 60 relative thereto.

As explained further below with respect to FIGS. 5-10, rotation of dial 60 manipulates the orientation of choke linkage 48 relative to throttle assembly 36 whereas longitudinal or axial movement of dial 60 effectuates operation of primer control 66. As shown in FIG. 2, primer control 66 is disposed generally between generator 26 and choke control 64 such that primer control 66 is positioned generally behind or underneath choke control 64. It is appreciated that the orientation of choke control 64 and primer control 66 relative to dial 60 could be reversed such that primer control 66 would be nearer dial 60 than choke control 64. Regardless of the specific orientation of dial 60, ignition control 62, choke control 64, and primer control 66 relative to one another, start control 22 provides a compact and single location associated with a single input control assembly associated with user interaction with ignition control 62, choke control 64, and primer control 66.

As shown in FIGS. 3-6, choke cable 52 includes a first end 78 that is secured to choke linkage 48 and a second end 81 that is secured to choke control 64. Choke cable 52 includes a cable 80 that slidably cooperates with a sheath 82. A clamp 84 secures choke cable 52 to engine 24 proximate throttle assembly 36 without interfering with the translatable association of cable 80 relative to sheath 82 such that operation of dial 60 facilitates the translation of cable 80 relative to sheath 82 and thereby adjustment of the choke linkage 48 associated with the position of the choke plate relative to throttle assembly of throttle assembly 36.

Figure 4:
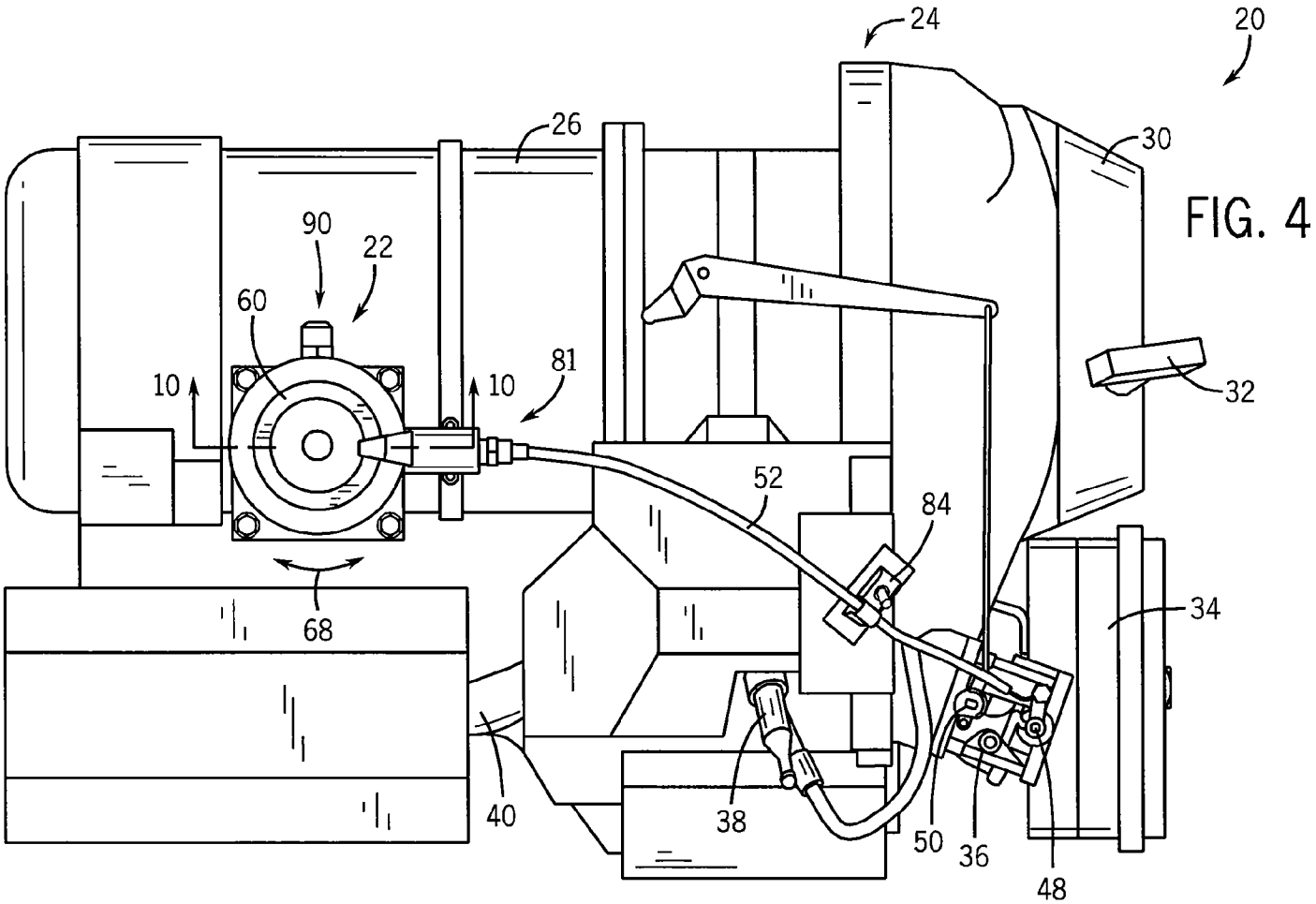
FIG. 4 is a top plan view of the assembly shown in FIG. 3.
Figure 5:
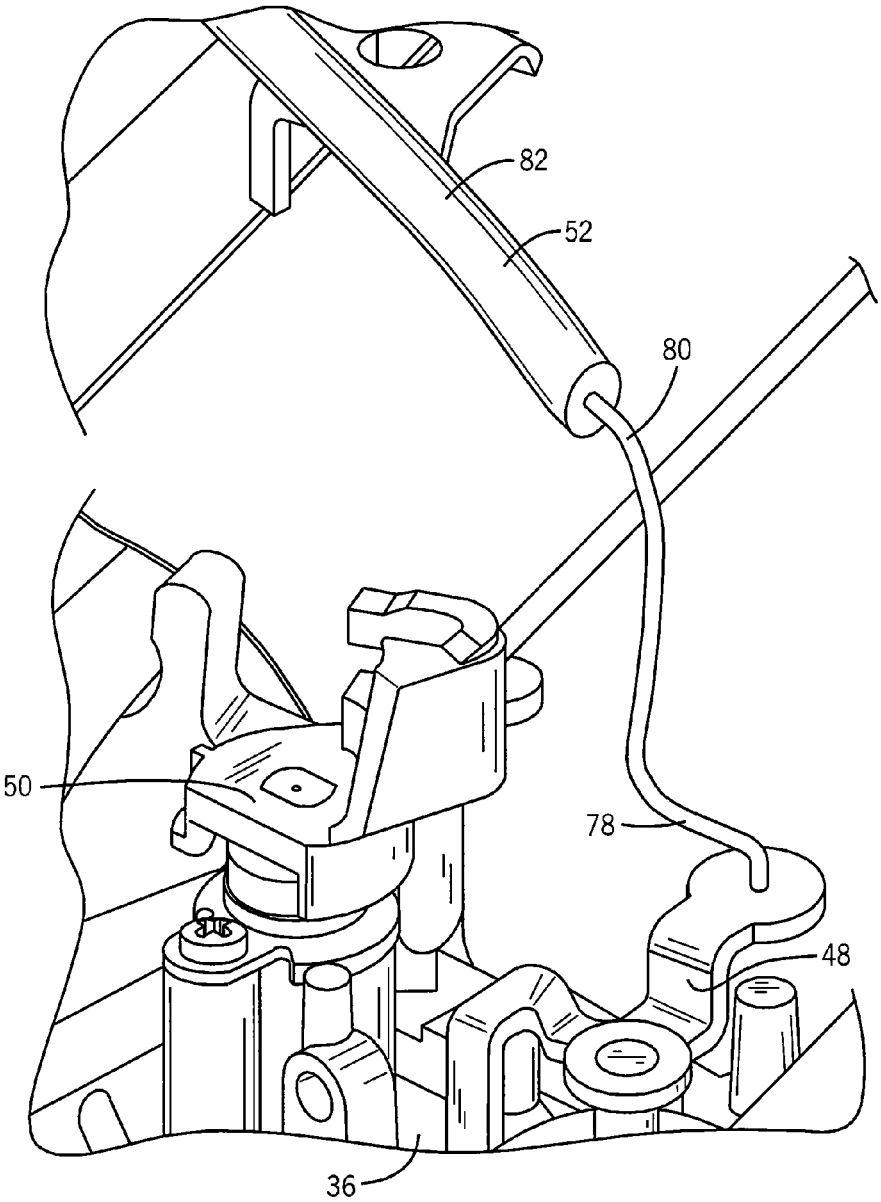
FIG. 5 is a partial perspective view of a throttle assembly of the engine powered device shown in FIG. 3.
Figure 6:
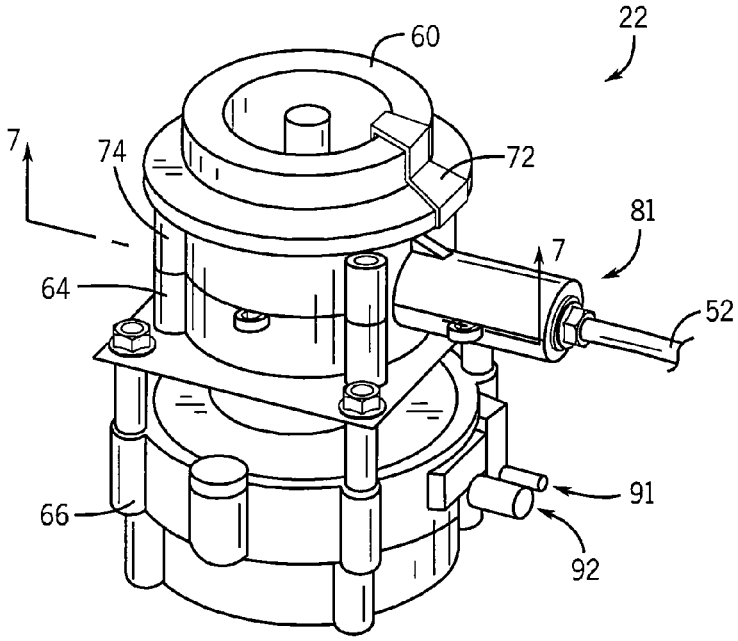
FIG. 6 is a perspective view of an engine control removed from the device shown in FIG. 1.

Referring to FIGS. 3 and 4, primer control 66 includes an inlet 90 and outlets 91, 92. Inlet 90 of primer control 66 is fluidly connected to a fuel source, such as a fuel reservoir or tank 94. Outlet 92 of primer control 66 is fluidly connected to fuel inlet 96 of throttle assembly 36. Outlet 91 of primer control 66 is fluidly connected to a vent 93 of throttle assembly 36. As is commonly understood, operation of a primer control such as primer control 66 facilitates an initial introduction of fuel to the carburetor or throttle assembly 36 associated with operation of engine 24. It is appreciated that primer control 66 can be configured to deliver fuel to the throttle assembly 36 from tank 94 or configured to draw fuel from tank 94 directly toward throttle assembly 36. Regardless of the specific configuration of primer control 66 and/or orientation of primer control 66 relative to the underlying engine 24, primer control 66 is configured to deliver an initial fuel charge to throttle assembly 36 and/or engine 24 such that engine 24 is operable thereafter to draw fuel from tank 94 without further user interaction and/or operation of primer control 66.

Figure 7:
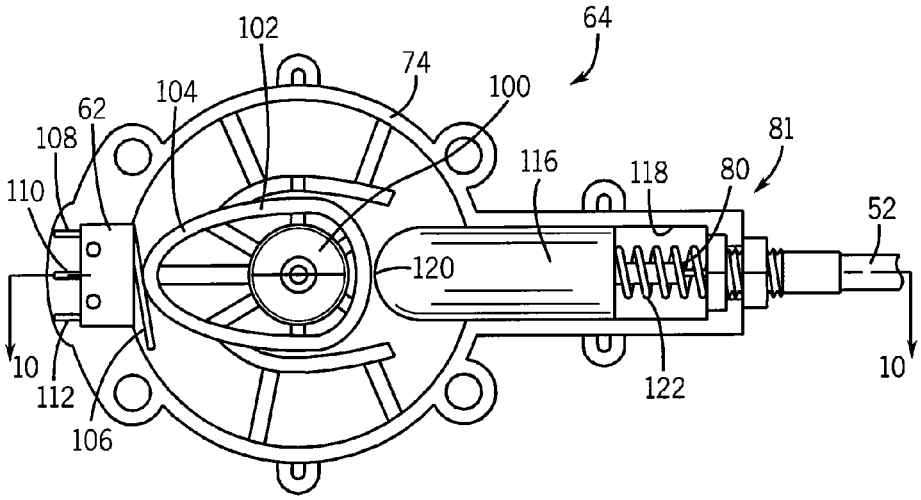
FIG. 7 is a plan view of a cross-section of the engine control shown in FIG. 6 taken along line 7-7 shown in FIG. 2 and shows an engine control in a first or "OFF" position associated with non-operation of the underlying engine.
Figure 8:
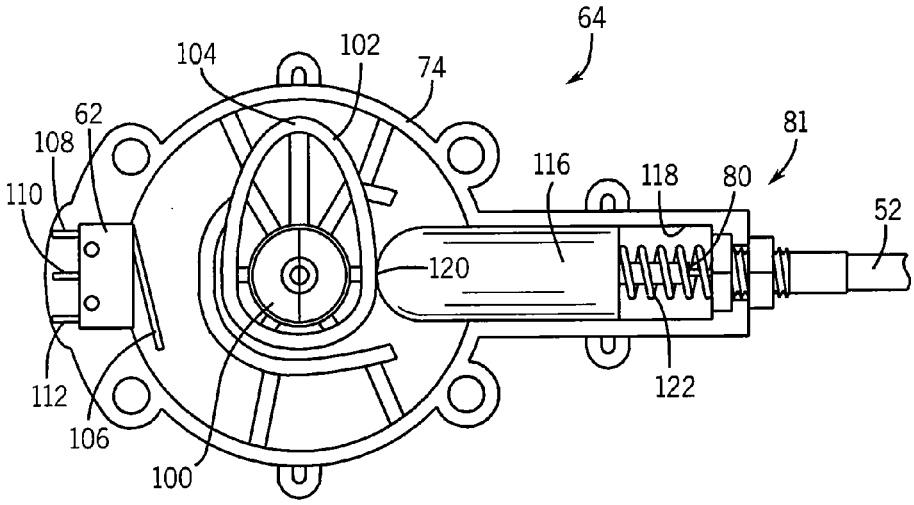
FIG. 8 is a view similar to FIG. 7 and shows the engine control in a second or "RUN" position.
Figure 9:
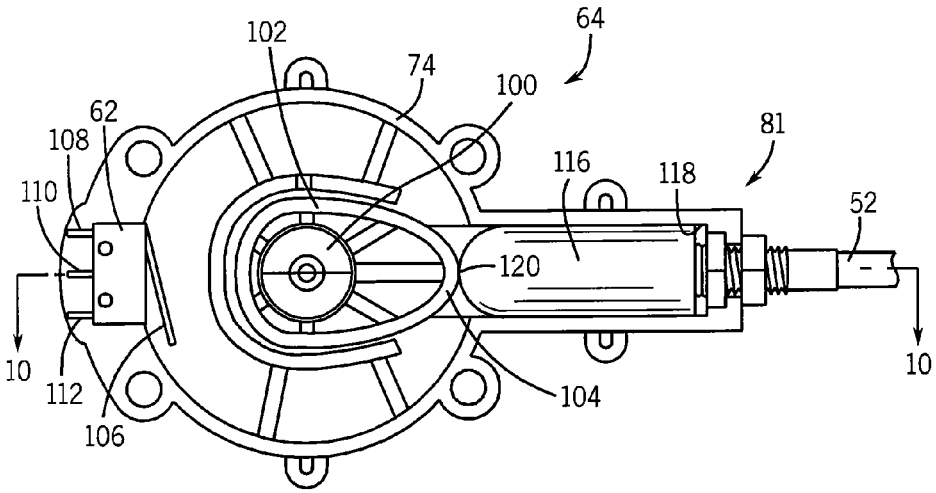
FIG. 9 is a view similar to FIG. 7 and shows the engine control in a third or "PRIME" position.

FIGS. 7-10 show cross-sectional views of choke control 64 of start control 22 with dial 60 oriented in alternate radial positions relative to housing 74. Dial 60 includes or engages a stem 100 that cooperates with housing 74 to define an axis of rotation of dial 60. A cam 102 is formed with or cooperates with stem 100 such that rotation of dial 60 relative to housing 74 effectuates rotation of cam 102. FIGS. 7-9 show the various rotational positions of cam 102, and thereby dial 60, relative to housing 74 of choke control 64. Cam 102 is rotationally secured to stem 100 and/or dial 60 such that rotation of dial 60 alters the radial orientation of a lobe 104 of cam 102 relative to housing 74 and thereby choke cable 52. As indicated by the orientation of lobe 104 relative to choke cable 52 in each of FIGS. 7-9, dial 60 is configured to achieve at least three distinct rotational positions with respect to housing 74 during an engine starting and running operation. The distinct rotational positions are associated with an engine OFF operation (as shown in FIG. 7), an engine "PRIME" and choke operation (as shown in FIG. 8), and an engine "RUN" operation (as shown in FIG. 9). Visual indicator 72 associated with dial 60 and/or a tactile indication as mentioned above provide an indication as to the radial orientation of dial 60 and thereby lobe 104, relative to the intended starting sequence associated with the given radial location of the dial 60 relative to housing 74 of choke control 64. It is appreciated that although the first, second, and third rotational positions of dial 60 as indicated by lobe 104 are shown as being oriented in ninety degree increments, other degrees of rotation are envisioned.

Figure 10:
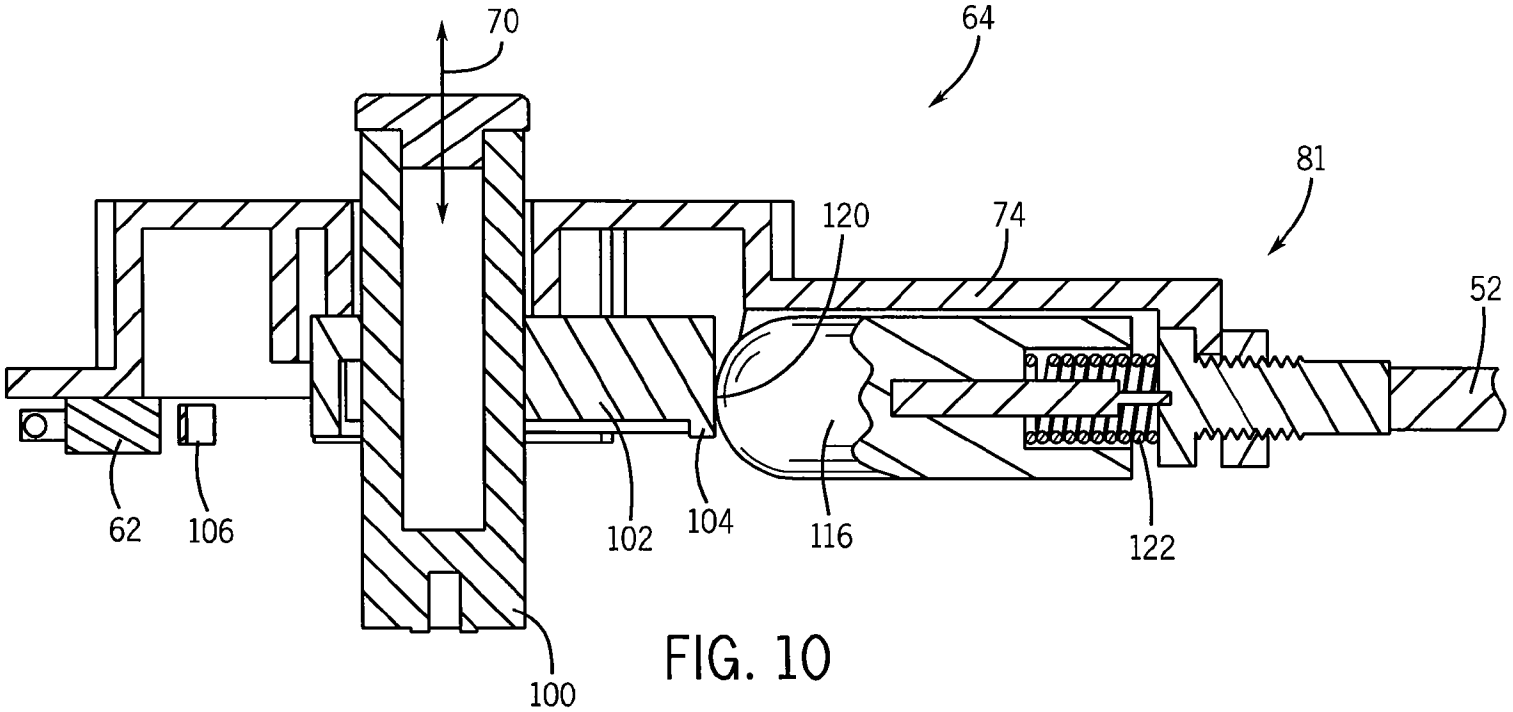
FIG. 10 is a partial view of a cross-section of the engine control shown in FIG. 6 taken along line 10-10 shown in FIG. 4.

As shown in FIGS. 7-10, ignition control 62 includes an arm 106 that interacts with lobe 104 of cam 102 and manipulates the conducting state of one or more conductors 108, 110, 112 associated with communicating a spark signal to spark plug 38 (FIG. 1). Preferably, when lobe 104 is aligned with arm 106 (FIG. 7), ignition control 62 provides an ignition system spark signal fault. As is commonly understood, faulting a combustion spark signal in such a manner prevents operation of engine 24 regardless of the fuel delivery system setting or conditions and/or user operation of recoil 30. Furthermore, when lobe 104 is rotated away from interaction with arm 106 (such as the orientations as shown in FIGS. 9 and 10, ignition control 62 is configured to communicate a combustion causing ignition signal to spark plug 38. Said in another way, with the satisfaction of fuel and/or combustion charge conditions, engine 24 can be started with operation of recoil 30 once dial 60, as indicated by lobe 104, is rotated away from the OFF position shown in FIG. 7.

The orientations of lobe 104 relative to housing 74 as shown in FIGS. 9 and 10 are indicative of conditioning the fuel delivery and combustion charge systems to deliver a desired fuel/air mixture associated with the priming and choking operations of engine to the combustion chamber of engine 24. As shown in FIG. 9, end 81 of choke cable 52 includes a terminal end 116 that is secured to cable 80 and movable relative to sheath 82 of cable 52 and housing 74 of choke control 64. Terminal end 116 slidably cooperates with a guide channel 118 formed by housing 74.

A spring 122 is disposed between terminal end 116 of choke cable 52 and housing 74 and biases the terminal end 116 of choke cable 52 into engagement with cam 102. Translation of terminal end 116 associated with cable 80 relative to housing 74 effectuates a corresponding translation of choke linkage 48 relative to throttle assembly 36. That is, movement of cable 80 relative to sheath 82 effectuates rotation of choke linkage 48 which thereby effectuates the position of a choke plate relative to throttle assembly 36. As such, as explained further below, rotation of dial 60 manipulates the position of the choke plate relative to throttle assembly 36 to effectuate an engine starting fuel and combustion ignition sequence.

Referring to FIGS. 7-9, it should be appreciated that dial 60 is rotatable relative to housing 74 such that cam 102 and lobe 104 cooperate with the follower associated with terminal end 116 to provide at least two alternate choke plate positions. It should be noted that in FIG. 7, lobe 104 faces generally away from terminal end 116 such that a contact face 120 of terminal end 116 is nearer the longitudinal center axis of stem 100 thereby providing one extreme associated with the choke plate position relative to the throttle assembly 36. Referring to FIGS. 8 and 9, as dial 60 is rotated away from the OFF position associated with FIG. 7 relative to housing 74, lobe 104 approaches longitudinal alignment with contact face 120 of terminal end 116 of choke cable 52 thereby achieving an alternate extreme associated with the position of the choke plate relative to the throttle body. That is, rotation of dial 60 effectuates the opening and closing of the choke plate associated with throttle assembly 36 via the rotational orientation of lobe 104 relative to the follower associated with contact face 120 of terminal end 116 of choke cable 52.

Referring to FIG. 10, stem 100 slidably cooperates with housing 74 along direction 70 such that depression of dial 60, facilitated by gap 71 (FIG. 1) to allow the axial or longitudinal movement of dial 60 along the axis of rotation from a first longitudinal position to a second longitudinal position relative to housing 74 allows operation of the primer control 66 which is maintained adjacent choke control 64. That is, when dial 60 is in the first longitudinal position, as shown in FIG. 3, gap 71 is formed between the underside of dial 60 and housing 74. When dial 60 is displaced to the second longitudinal position, dial 60 occupies some or all of the space associated with gap 71. Preferably, dial 60 is biased to the first longitudinal or axial position thereby requiring the user's pressing of the dial to effectuate operation of primer control 66. The outer circumference of cam 102 is configured to slidably cooperate with the contact face 120 of choke cable 52. Regardless of the specific construction, stem 100 is rotatable relative to housing 74 to effectuate rotation of lobe 104 relative to terminal end 116 of choke cable 52 thereby controlling operation of the choke control 64 and slidable in direction 70 relative to housing 74 thereby controlling the primer control 66 which is aligned therewith.

During an initial engine starting sequence, dial 60 is rotated from the OFF position, associated with the orientation of lobe 104 shown in FIG. 7 to a PRIME position, associated with the orientation of lobe 104 shown in FIG. 9. When in the PRIME position, ignition signal control 62 allows communication of a spark ignition signal to spark plug 38 and the choke plate associated with choke cable 52 is maintained in a closed position relative to the corresponding throttle body. When in the PRIME position, dial 60 is depressed one or more times and for selected durations to effectuate operation of primer control 66. Recoil 30 is preferably operated one or more times until an initial engine combustion is detected. Preferably, primer control 66 is operated one time for a duration of several seconds and recoil 30 is operated two times.

After the engine PRIME operation associated with the orientation of dial 60 indicated in FIG. 9, dial 60 is again rotated to a RUN position associated with the alignment of lobe 104 with terminal end 116 of choke cable 52 so as to open the choke plate associated with the throttle body. When in the orientation shown in FIG. 8, it should be appreciated that ignition control 62 maintains a configuration wherein a spark signal can be generated by spark plug 38. One or two subsequent operations of recoil 30 preferably result in self supported operation of engine 24. If the engine does not start or the engine fires but does not continue to run, dial 60 can be returned to the PRIME orientation, the sequence of priming and choking the engine can be repeated, and a subsequent attempt to start the engine can be made by returning the dial to the RUN orientation and pulling recoil handle 32. Preferably, engine 24 and the choke and primer assemblies associated with throttle assembly 36 are calibrated such that engine 24 will start with completion of a single starting sequence of start control 22. When it is desired to stop engine 24, the user need simply return dial 60 to the OFF position thereby suspending communication of the ignition signal to spark plug 38 effectively stopping the engine in a manner that allows subsequent operation of device 20 by repeating the starting sequence explained above. Accordingly, engine start control 22 provides a single input assembly that allows the user to control the prime, choke, and ignition system configuration to start engine 24 via interaction with the single input associated with dial 60. As such, the configuration allows even inexperienced operators or user to expeditiously start engine 24 of device 20.

Many changes and modifications could be made to the invention without departing from the spirit thereof. The scope of these changes will become apparent from the appended claims.

The invention claimed is:

1. A control assembly for manipulating operation of an internal combustion engine, the control assembly comprising:

a choke control system connectable to a throttle body and having a choke control to manipulate a position of a plate associated with the throttle body;

a primer system connected to a fuel system, the primer system having a primer control configured to prime an engine associated with the throttle body; and a dial operatively connected the choke control system and the primer system and extending along an axis, the dial: rotatable about the axis between an off position wherein the choke control system prevents operation of the engine, a run position wherein the choke control system opens the plate associated with the throttle body, and a prime position wherein a spark ignition signal is allowed to communicate with a spark plug of the internal combustion engine; and being longitudinally translatable along the axis between a first position and a second position wherein the primer system delivers an initial fuel charge to the throttle body.

2. The control assembly of claim 1 wherein the dial is biased toward the first position.

3. The control assembly of claim 1 further comprising a cam attached to the dial and a cam follower attached to an end of a choke cable.

4. The control assembly of claim 3 further comprising a spring oriented to bias the cam follower into engagement with the cam.

5. The control assembly of claim 1 wherein the primer system is disposed between the fuel system and a device powered by operation of the internal combustion engine.

6. A control assembly for manipulating operation of an engine of a portable engine powered device, the control assembly comprising:

a dial extending along an axis, the dial being rotatable relative to a housing and being axially moveable between first and second positions;

a cam connected to the dial and connected to a throttle assembly to manipulate an orientation of a plate relative to a throttle body in response to rotation of the dial; and a primer control operatively connected to the dial and to a fuel system, the primer control configured to prime the engine in response to axial movement of the dial from the first position to the second position.

7. The control assembly of claim 6 wherein the dial is biased toward the first.

8. The control assembly of claim 6 wherein the dial is rotatable between a first rotational position associated with an engine "OFF" condition, a second rotational position, and a third rotational position associated with an engine "RUN" condition, and the dial is movable between the first and second position when the dial is in the second rotational position.

9. The control assembly of claim 6 further comprising a switch connected to an ignition system of the engine, the switch configured to allow selective communication of an ignition signal to a spark plug associated with operation of the engine.

10. The control assembly of claim 6 wherein the throttle assembly further comprises a choke cable having a terminal end that is slidably associated with the cam.

11. The control assembly of claim 10 further comprising a spring disposed between the housing and the terminal end oriented to bias the terminal end into engagement with the cam.

12. The control assembly of claim 6 further comprising a generator configured to generate electrical power during operation of the engine.

13. The control assembly of claim 6 further comprising a recoil connected to the engine.

14. A portable engine powered device comprising:

a throttle body having a moveable plate connected to an internal combustion engine;

a choke control operatively connected to the plate relative to the throttle body;

a primer connected to a fuel system associated with operation of the internal combustion engine such that operation of the primer communicates an initial fuel charge to the throttle body; and a dial operatively connected the choke control and the primer and extending along an axis, the dial:

rotatable about the axis between a run position wherein the choke control opens the plate associated with the throttle body, and a prime position wherein a spark ignition signal is allowed to communicate with a spark plug of the internal combustion engine; and being longitudinally translatable along the axis between a first position and a second position wherein the primer delivers the initial fuel charge to the throttle body.

15. The portable engine powered device of claim 14 further comprising a cam connected to the dial and oriented to cooperate with a follower secured to a choke cable connected between the plate and the choke control.

16. The portable engine powered device of claim 15 further comprising a spring associated with the follower and oriented to bias the follower into engagement with the cam.

17. The portable engine powered device of claim 16 wherein the cam rotatably cooperates with the follower and is slidable, in a direction aligned with an axis of rotation of the cam, relative to the follower.

18. The portable engine powered device of claim 14 further comprising a switch connected to the housing of the choke control, the switch configured to create an ignition system fault depending on a rotational position of the dial relative to the housing.

* * * * *